United States Patent [19]

Gandy et al.

[11] Patent Number: 5,033,216

[45] **Date of Patent: * Jul. 23, 1991**

[54] SIGN ASSEMBLY

[75] Inventors: James Gandy; Bruce E. S. MacDonald, both of Mississauga, Canada

[73] Assignee: Signtech Inc., Canada

[ * ] Notice: The portion of the term of this patent subsequent to Jul. 3, 2007 has been disclaimed.

[21] Appl. No.: 518,103

[22] Filed: May 2, 1990

Related U.S. Application Data

[63] Continuation-in-part of Ser. No. 321,044, Mar. 9, 1989, Pat. No. 4,937,961.

[51] Int. Cl.[5] ..... G09F 17/00

[52] U.S. Cl. ..... 40/603; 40/574; 160/378; 38/102.91

[58] Field of Search ..... 40/603, 604, 574; 38/102.1, 102.3, 102.2, 102.91; 24/460, 461, 462, 546, 555, 556, 563; 160/378, 399, 402

[56] References Cited

U.S. PATENT DOCUMENTS

| | | | |
|---|---|---|---|
| 3,329,195 | 7/1967 | Kochanowski | 160/399 X |
| 3,529,653 | 9/1970 | Fey, Jr. | 160/378 X |
| 3,803,671 | 4/1974 | Stuppy et al. | 24/460 |
| 4,452,000 | 6/1984 | Gandy | 40/574 |
| 4,554,754 | 11/1985 | Stilling | 40/603 |

*Primary Examiner*—Kenneth J. Dorner
*Assistant Examiner*—J. Bonifanti
*Attorney, Agent, or Firm*—Davis, Bujold & Streck

[57] ABSTRACT

A frame member for a sign assembly for use with flexible signs comprises an elongated body having an outer side having a front edge which defines a lip for engaging a back side of an edge portion of the sign and applying a tensile force to the sign. The channel extends longitudinally of the body and inwardly of the outer side thereof and opens in the outer side for receiving in edgewise fashion an elongated tensioning bar having an edge portion of the sign folded thereover and secured thereto by a plurality of spring clips. The channel is formed with a plurality of transversely spaced, inwardly facing shoulders which are engageable with the spring clips for securing the edge portion of the sign within the channel and enabling the sign to be tensioned by urging the tensioning bar inwardly of the channel to enable the material clamping means to successively engage successive shoulders.

24 Claims, 3 Drawing Sheets

FIG.3.
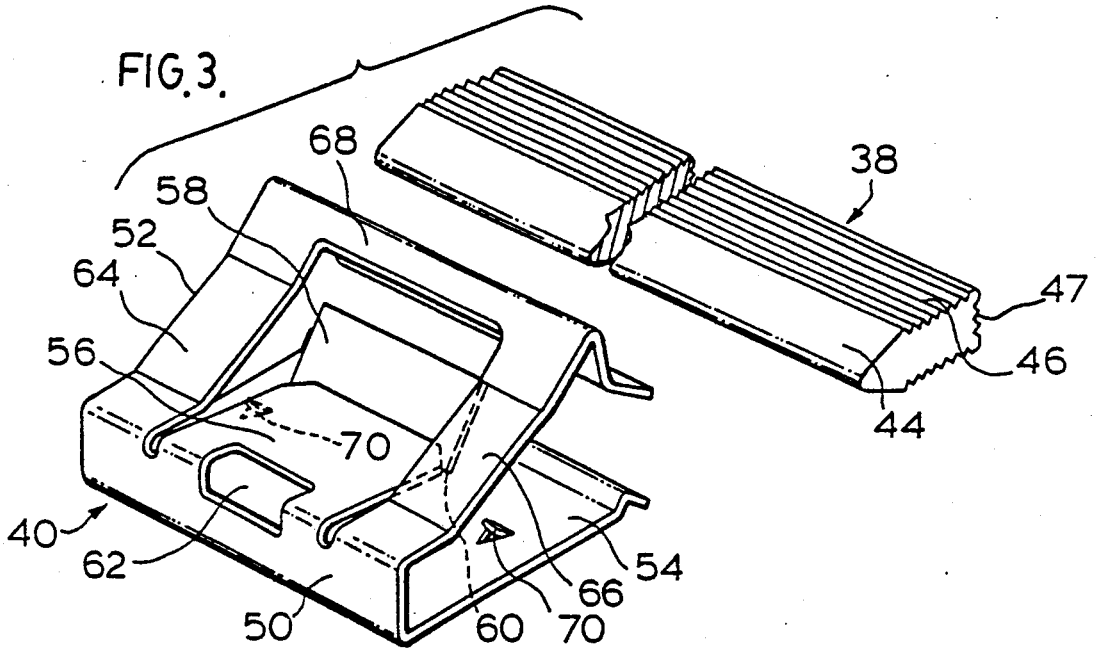
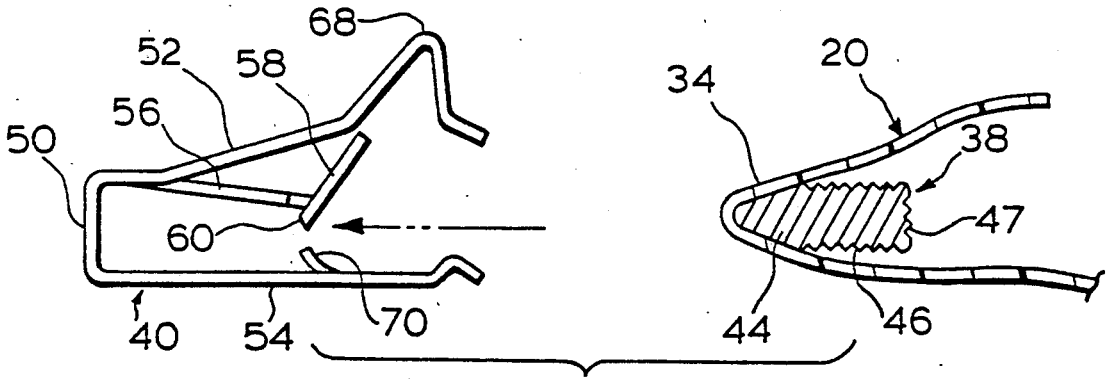
FIG.4.
FIG.5.
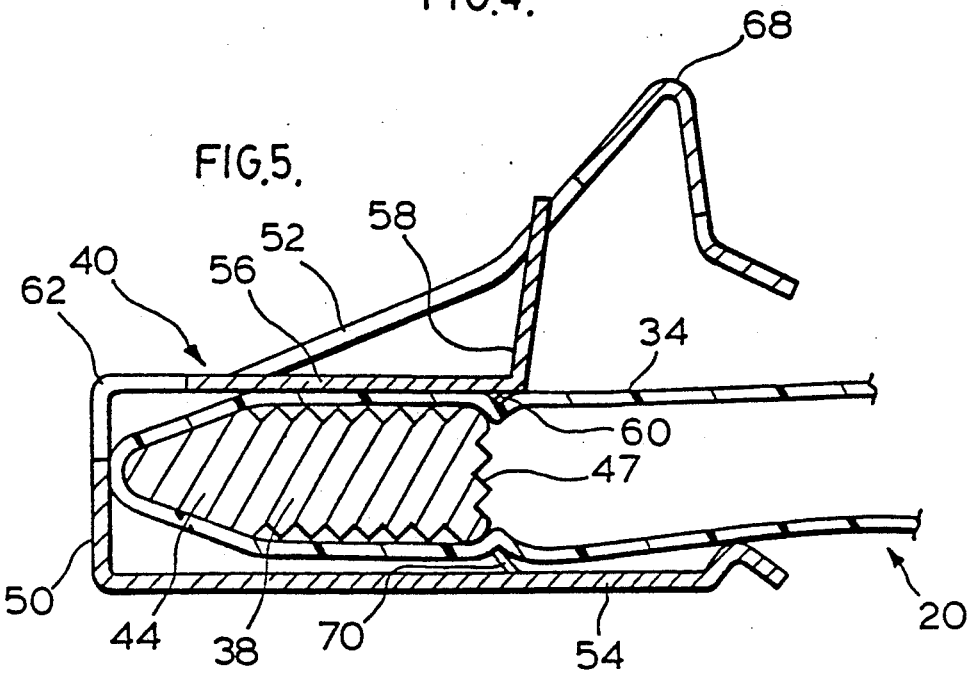

SIGN ASSEMBLY

This is a continuation-in-part of copending application Ser. No. 07/321,044 filed on Mar. 9, 1989, now U.S. Pat. No. 4,937,961.

The present invention relates to sign assemblies which have a sign-bearing sheet of flexible material stretched across a frame.

BACKGROUND OF THE INVENTION

A sign assembly of this kind is described in U.S. Pat. No. 4,542,605 (Gandy) issued 24 Sept. 1985, the contents of which are hereby incorporated herein by reference. In this prior patent, the flexible sign sheet is tensioned across the frame by a series of separate tensioning devices spaced around the frame, each tensioning device comprising a screw which can be adjusted to increase the tension of the sign sheet across the frame. Although this arrangement provides an effective tensioning procedure, there is currently a need for a simplified procedure.

SUMMARY OF THE INVENTION

The present invention seeks to provide a sign assembly of the type referred to which enables a flexible sign sheet to be tensioned more easily and without the use of tools than is the case with known sign assemblies of this kind. This is achieved by providing each of the frame members which form the sign frame with an elongated channel to receive, in edgewise fashion, a sign material tensioning bar over which an edge of the material has been folded and secured thereto by a plurality of spring clips. The channel is formed with a series of shoulders which are engageable with the spring clips. Thus, when it is desired to increase the tension on the sign, it is simply a matter of urging the tensioning bar farther into the channel to cause the spring clips to engage successively inwardly disposed shoulders.

According to one aspect of the present invention, there is provided a frame member for a sign assembly for use with a flexible sign, the frame member comprising an elongated body having an outer side having a front edge defining a lip for engaging a back side of an edge portion of the sign and applying a tensile force to the sign, a channel extending longitudinally of the body and inwardly of the outer side, a channel opening in the outer side for receiving in edgewise fashion an elongated tensioning bar having the edge portion of the sign folded thereover and secured thereto by material clamping means, a plurality of transversely spaced, inwardly facing shoulder means in the channel, the shoulder means being engageable with the material clamping means for securing the edge portion of the sign within the channel and enabling the sign to be tensioned by urging the tensioning bar inwardly of the channel to enable the material clamping means to successively engage successive shoulders.

In accordance with another aspect of the present invention, there is provided a tensioning clip for securing an edge of flexible sign material to an elongated tensioning bar and securing the tensioning bar within a channel of a sign frame member, the clip comprising a unitary, generally U-shaped body having a substantially rigid base portion and a pair of resilient arms extending from opposed edges of the base portion, the arms being spaced apart to receive in edgewise fashion a tensioning bar therebetween, means on at least one of the arms for retaining the tensioning bar and sign material folded thereover operatively positioned between the arms such that a longitudinal edge of the tensioning bar engages the base portion, and means on one of the arms for engaging a mating shoulder within the channel for retaining the clip and a tensioning bar secured thereto within the channel.

BRIEF DESCRIPTION OF THE DRAWINGS

These and other features of the invention will become more apparent from the following description in which reference is made to the appended drawings wherein:

FIG. 3 is an exploded perspective view of a clip and the mounting bar, with the sign sheet being omitted for clarity;

FIG. 4 is an exploded sectional side view thereof also showing the sign sheet;

FIG. 5 is a sectional side view of a clip fully assembled with the sign sheet and mounting bar;

DESCRIPTION OF PREFERRED EMBODIMENT

Figure 1:
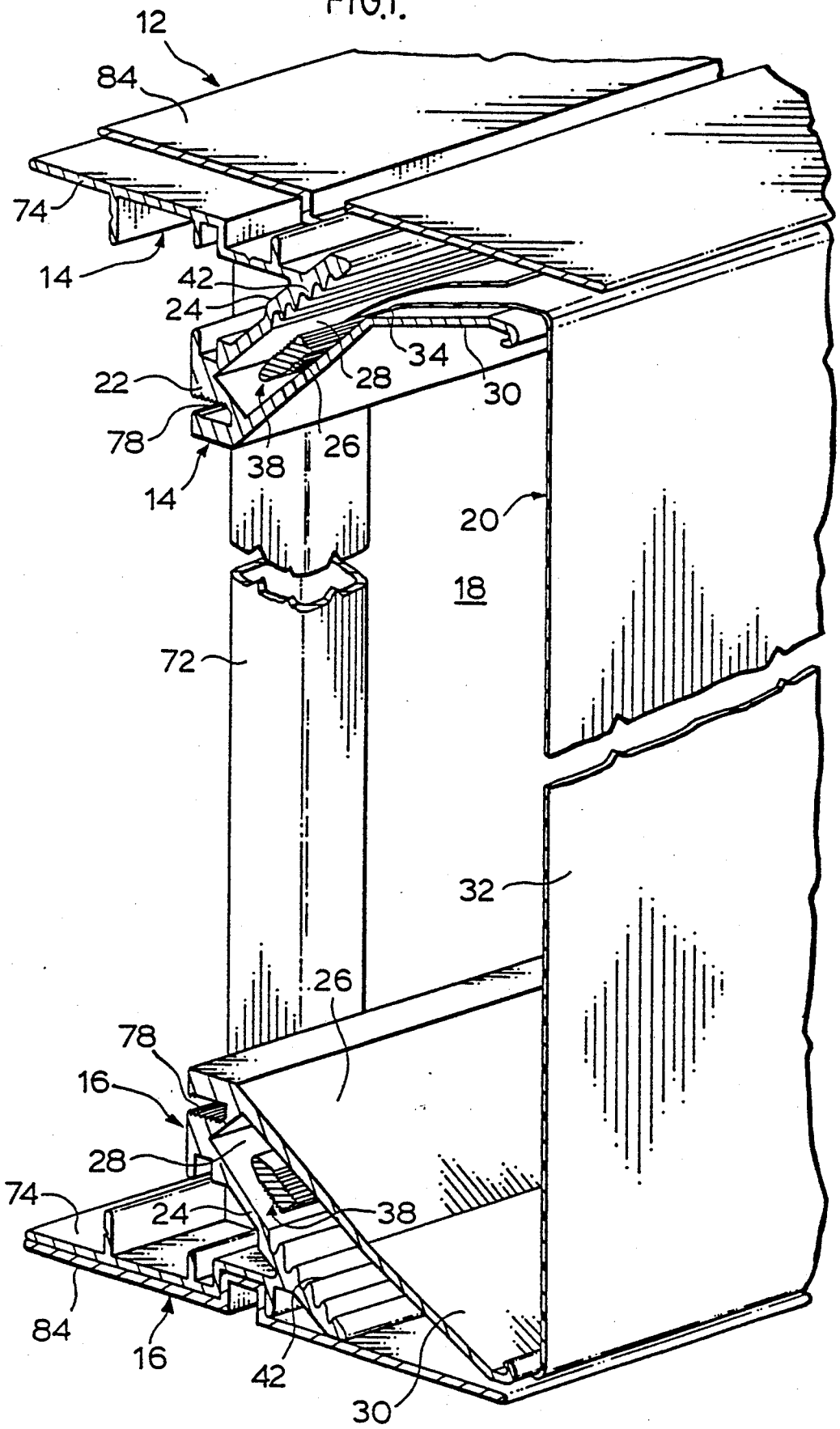
FIG. 1 is a perspective end view, partly in section, of a sign assembly showing upper and lower frame members, the flexible sign sheet and a bracing member.

Referring to the drawings, a sign assembly has a rectangular frame 12 whose upper and lower frame members 14, 16 are shown in FIG. 1. It will be understood that the frame 12 will also have left and right hand side frame members (not shown). The various frame members are secured together at their ends by corner pieces (also not shown) to form a rectangular frame in a manner which will be readily apparent to a person skilled in the art. Each frame member is an aluminum extrusion. The frame members define an aperture 18 across which a sheet 20 of flexible sign material is stretched. Further description will be primarily in connection with upper frame 14, but it will be understood that such description also applies to the lower frame member 16 and the side frame members.

Figure 2:
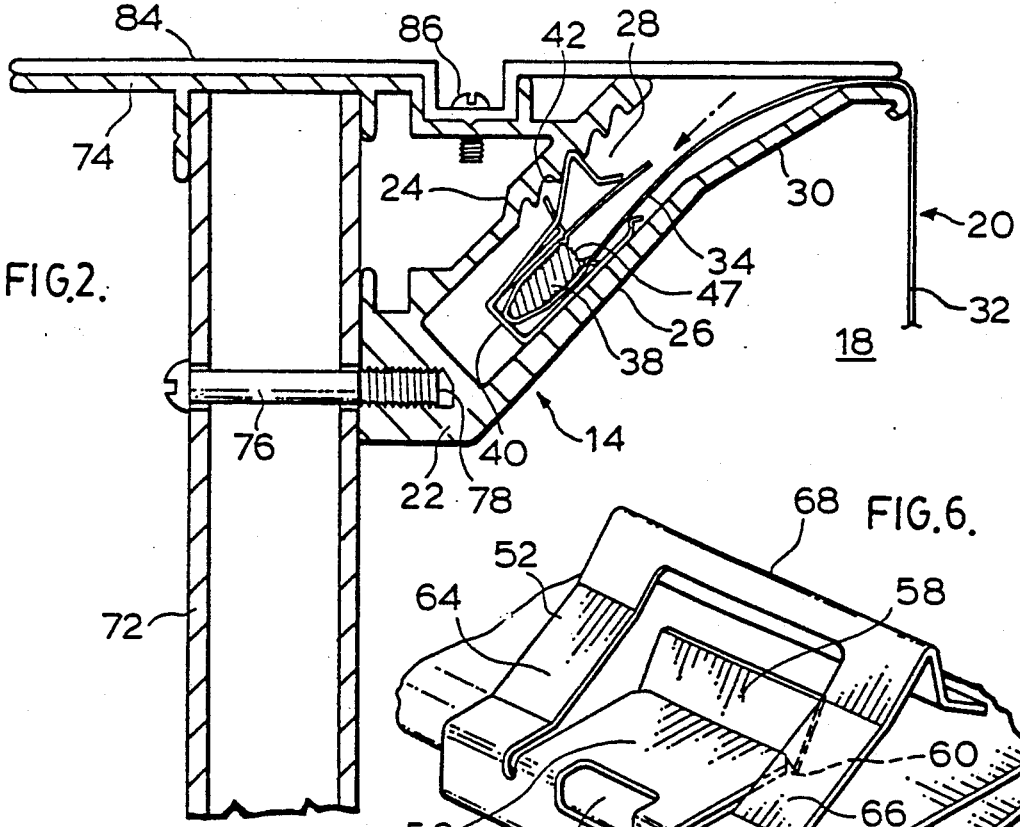
FIG. 2 is a transverse sectional view of the upper part of the sign assembly showing the upper frame member, flexible sign sheet and bracing member.

As shown particularly in FIG. 2, the upper frame member 14 has an elongated body or base 22 from which upper and lower spaced walls 24, 26 extend at an angle of 45° to the vertical. The walls 24, 26 and base portion 22 form a U-shaped channel portion defining a channel 28. The lower wall 26 extends beyond the upper wall 24 to form a lip member 30 which defines the edges of the aperture 18.

The sign sheet 20 has a main portion 32 extending across the aperture 18 and an end portion 34 which passes around the free end of the lip member 30 and into the channel 28. The sheet end portion 34 is retained in the channel 28 by a tensioning or mounting bar 38 and a plurality of clips 40. The sheet end portion 34 is folded over tensioning bar 38 and held thereon by the clips 40 which are spaced along the tensioning bar 38. Each clip 40 is in turn retained within the channel 28 by engagement with one of a series of rearwardly facing shoulders 42 formed on the inner surface of the upper wall 28. The tensioning bar 38 has a generally rectangular section, except that the rear end portion 44 is tapered. Forwardly of the tapered rear end portion 44, the upper and lower surfaces of the tensioning bar 38 have closely spaced longitudinally extending ridges 46 which serve to grip the resilient material of sheet 20. The tensioning bar 38 is also an aluminum extrusion.

Each clip 40 is of resilient sheet metal and is formed by stamping and bending. The clip 40 is U-shaped with a base 50 and opposite sides or arms 52, 54. The medial portion of the side 52 is stamped out to form a tongue 56 which initially is inclined inwardly from the base 50 towards the opposite side 54. The free end portion 58 is bent to extend in an outwardly inclined direction and is provided with a pair of inwardly and rearwardly extending prongs 60 at the line of bending. A portion of the tongue 56 and base 50 is removed to leave an aperture 62, thereby permitting the tongue 56 to flex more easily relative to the base 50.

The remaining portion of the side 52 extends around the tongue 56 and comprises arms 64, 66 which extend from the base 50 and a free end portion 68 extending transversely between the outer ends of the arms 64, 66. After initially extending parallel to the opposite side 54, the arms 64, 66 extend in an outwardly inclined direction to the free end portion 68 which is shaped to provide an outwardly projecting shoulder. The opposite side 54 of the clip 40 has a pair of prongs 70 stamped out therefrom, the prongs 70 being directed inwardly and rearwardly.

The upper and lower frame members 14, 16 are prevented from being bowed inwardly under the tension of the sign sheet 20 by transversely spaced bracing bars 72. Each bracing bar 72 is a tubular member whose upper end engages the underside of a flange 74 of the frame member 14 which extends rearwardly from the upper wall 24 of the channel 28. Similarly, the lower end of bracing bar 72 engages the upper surface of a similar part 76 of the frame member 16. Each bracing bar 72 is secured to the base 22 of the frame member 14 by a bolt 76 which passes through bracing bar 72 into a longitudinally extending groove 78 in the base 22 of the frame member 14. The groove 78 has longitudinally extending ridges 80 in opposed walls to engage the threads of the screws 76. The bracing bar 72 is also secured to the lower frame member 16 in a similar manner (not shown).

Figure 6:
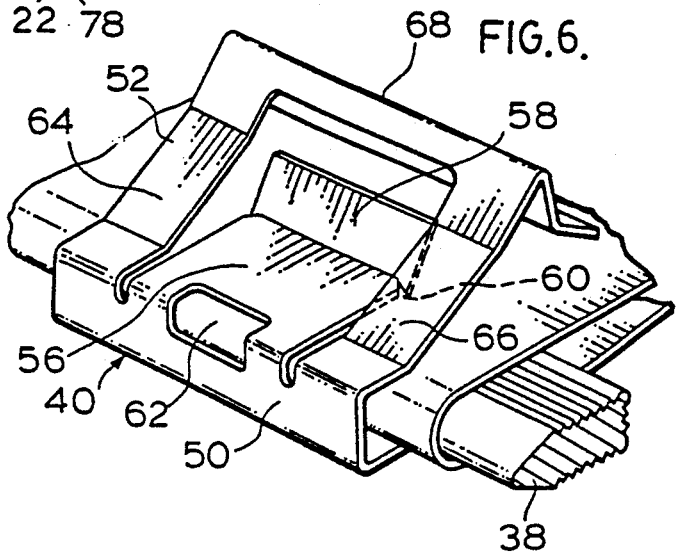
FIG. 6 is a perspective view thereof.

When assembling the sign sheet 20 with the frame 12, the sheet end portion 34 is wrapped around the tensioning bar 38 of each sheet holding assembly 36 in turn. The clips 40 are then pushed onto the tensioning bar 38 at longitudinally spaced intervals, see FIGS. 4 to 6, until the tapered end 44 of the tensioning bar 38 engages the base 50 of each clip 40 (with the sheet end portion 34 therebetween). The prongs 60 on the tongue 56 and the prong 70 on the lower side 54 of each clip snap over and engage front end 47 of the tensioning bar 38, thereby retaining the clips 40 and also the sign sheet portion 34 in engagement with tensioning bar 38.

Figure 7:
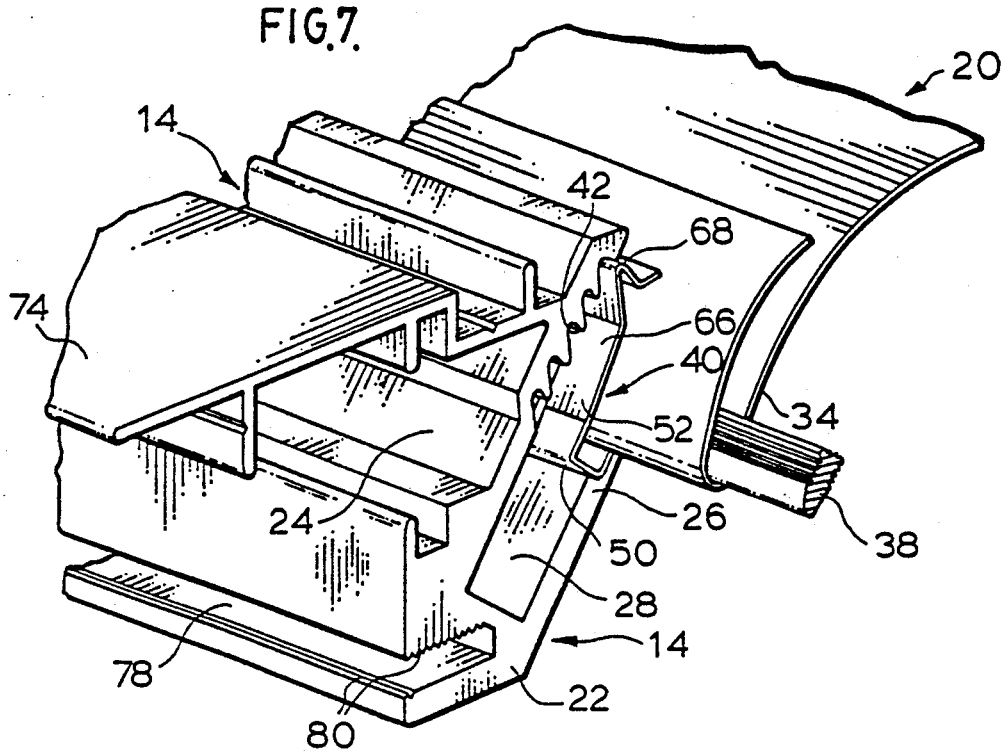
FIG. 7 is a perspective view showing the clip with contained sign sheet and mounting bar being inserted into the channel in the upper frame member.

The tensioning bar 38 with assembled sign end portion 34 and clips 40 is then inserted into a channel 28 of the frame member 14 or 16 as the case may be, see FIG. 7, until the sign sheet 20 is suitably tensioned. During such insertion, the outward projection 68 on the upper wall of each clip 40 snaps past each shoulder 42 in the channel 28 in turn more so that each clip 40 is retained in position by the shoulder 42 then engaged by the clip 40.

In practice, the tensioning bars 38 will be inserted an initial distance into the channels 28 in the upper and lower frame members 14, 16 until the sign sheet 20 is almost taut. The tensioning bars 38 are then pushed further into the channels 28 in turn until the desired tension in the sign sheet 20 is achieved. Similar comments apply of course to the side frame members.

When the sign sheet 20 has been suitably tensioned, a cover plate 84 is fitted to the exterior of each frame member. As shown in FIG. 2, the cover plate 84 is secured to frame member 14 by screws 86 spaced therealong. The cover plate 84 covers the top of the frame member 14 so as to conceal the channel 28 and sheet end portions 34. The cover plate 84 also extends rearwardly across the rearward extension 74 of the frame member 14. A cover plate 84 is similarly secured to each of the various frame members.

It will be noted that, because of the angular disposition of the lip members 30 of the frame members, the channels 28 are positioned within the periphery of and behind the main portion 32 of the sign sheet 20 so that the frame is hidden behind the sign sheet main portion 32 when the sign assembly is viewed from the front. As previously mentioned, the cover plates 84 cover the frame members from other angles of view, thereby providing the sign assembly with an attractive appearance (as is also the case in U.S. Pat. No. 4,542,605 previously referred to).

In a typical sign assembly, the length of the upper and lower frame members 14, 16 may be about 20 feet, with the length of the side members being about 4 feet. The clips 40 may be spaced apart at intervals of about 6 to 8 inches on the tensioning bars 38. For convenience, two tensioning bars 38 each with a length of about 10 feet may be provided for each of the upper and lower frame members. The bracing bars 72 may be spaced apart by about 4 to 5 feet.

The easy installation of a sign sheet 20 on the frame in accordance with the invention will be readily appreciated by a person skilled in the art by the foregoing description of a preferred embodiment. It will be noted that each clip 40 can be removed from the channel 28 by disengaging the outward projection 68 therefrom with a suitable tool (such as a screw driver) from shoulder 42, at the same time pulling the sheet end portion 34 out of the channel 28.

Other embodiments of the invention will also be readily apparent to a person skilled in the art, the scope of the invention being defined in the appended claims.

The embodiments of the invention in which an exclusive property of privilege is claimed are defined as follows:

1. A frame member for a sign assembly for use with a flexible sign, said frame member comprising an elongated body having:

an outer side having a front edge defining a lip for engaging a back side of an edge portion of said sign and applying a tensile force to said sign;

a channel extending longitudinally of said body and inwardly of said outer side;

a channel opening in said outer side for receiving in edgewise fashion an elongated tensioning bar having said edge portion of said sign folded thereover and secured thereto by material clamping means;

a plurality of transversely spaced, inwardly facing shoulder means in said channel, said shoulder means being engageable with said material clamping means for securing said edge portion of said sign within said channel and enabling said sign to be tensioned by urging said tensioning bar inwardly of said channel to enable said material clamping means to successively engage successive shoulders.

2. A frame member as defined in claim 1, said channel extending at an acute angle to said outer side of said body and rearwardly away from said front edge.

3. A frame member as defined in claim 1, said body further including a substantially planar longitudinal flange defining said outer side of said body.

4. A frame member as defined in claim 1, said body further having a back side surface for engagement with a brace member extending between a pair of said frame members.

5. A frame member as defined in claim 4, said back side being planar and extending substantially perpendicularly of said flange, said flange having an underside engageable with an end of said brace member.

6. A frame member as defined in claim 1, further including a substantially planar cover plate adapted to be detachably secured to said outer side for closing said opening.

7. A frame member as defined in claim 1, said body further including a substantially planar longitudinal flange defining said outer side of said body, a back surface for engagement with a brace member extending between a pair of said frame members, said back surface being planar and extending substantially perpendicularly of said flange, said flange having an underside engageable with one end of said brace member, said channel extending at an acute angle to said outer side of said body and rearwardly away from said front edge and having opposed side walls, one of said walls being remote from said front edge, the other of said side walls being proximate said front edge.

8. A tensioning clip for securing an edge of flexible sign material to an elongated tensioning bar and securing said tensioning bar within a channel of a sign frame member, said clip comprising:

a unitary, generally U-shaped body having a substantially rigid base portion and a pair of resilient arms extending from opposed edges of said base portion, said arms being spaced apart to receive in edgewise fashion a tensioning bar therebetween;

means on at least one of said arms for retaining said tensioning bar and sign material folded thereover operatively positioned between said arms such that a longitudinal edge of said tensioning bar engages said base portion; and means on one of said arms for engaging a mating shoulder within said channel for retaining said clip and a tensioning bar secured thereto within said channel.

9. A tensioning clip as defined in claim 8, said one of said arms further including a flexible tongue extending from said base portion, said tensioning bar engaging means including at least one prong extending inwardly from a free end of said tongue and rearwardly toward said base portion.

10. A tensioning clip as defined in claim 9, said tensioning bar engaging means further including at least one prong extending inwardly of the other of said arms and rearwardly toward said base portion.

11. A tensioning clip as defined in claim 10, said prongs being engageable with an edge of said tensioning bar opposite said longitudinal edge thereof.

12. A tensioning clip as defined in claim 9, said one of said arms including:

first and second flexible arms portions, each said arm portion having a fixed end extending from one of said edges of said base portion and a free end;

a transverse portion extending between and connecting said free ends of said arm portions, said shoulder engaging means including a shoulder extending outwardly of said transverse portion; and a flexible tongue portion having a fixed end extending from said one of said edges of said base portion between said fixed ends of said arm portions and a free end, said tensioning bar engaging means including at least one prong extending inwardly from said free end of said tongue into the space between said arms and rearwardly toward said base portion.

13. A tensioning clip as defined in claim 12, said tensioning bar engaging means further including at least one prong extending inwardly of the other of said arms and rearwardly toward said base portion.

14. A sign assembly for use with flexible sign, said sign assembly comprising, in combination:

four elongated frame members adapted to be joined together in end-to-end relation so as to form a substantially rectangular frame, each said frame member having an outer side, said outer side having a front edge defining a lip for engaging a back side of an edge portion of said sign and applying a tensile force thereto, a channel extending longitudinally of said body and opening in said outer side proximate said front edge and a plurality of inwardly spaced and inwardly facing shoulder means in said channel;

an elongated tensioning bar associated with each said frame member for insertion in edgewise fashion with an edge of sign material folded thereover into the channel of its associated frame member; and a plurality tensioning clips associated with each said tensioning bar for securing to said tensioning bar an edge of said flexible sign folded over its associated tensioning bar and for engagement with said shoulder means in said channel for securing said tensioning bar and sign material secured thereto within said associated channel, whereby said flexible sign may be tensioned in orthogonal directions by urging one or both tensioning bars in opposed frame members inwardly of their respective channels to cause said tensioning clips to engage successive ones of said shoulders means.

15. A sign assembly as defined in claim 14, said channel of each said frame member extending at an acute angle to said outer side thereof and rearwardly away from said front edge.

16. A sign assembly as defined in claim 15, each said frame member further including a substantially planar longitudinal flange defining said outer side of said frame member.

17. A sign assembly as defined in claim 14, each said clip comprising:

a unitary, generally U-shaped body having a substantially rigid base portion and a pair of resilient arms extending from opposed edges of said base portion, said arms being spaced apart to receive in edgewise fashion a tensioning bar therebetween;

means on at least one of said arms for retaining said tensioning bar and sign material folded thereover operatively positioned between said arms such that a longitudinal edge of said tensioning bar engages said base portion; and means on one of said arms for engaging a mating shoulder within said channel for retaining said clip and a tensioning bar secured thereto within said channel.

18. A sign assembly as defined in claim 17, said one of said arms further including a flexible tongue extending from said base portion, said tensioning bar engaging means including at least one prong extending inwardly from a free end of said tongue and rearwardly toward said base portion.

19. A sign assembly as defined in claim 18, said tensioning bar engaging means further including at least one prong extending inwardly of the other of said arms and rearwardly toward said base portion.

20. A sign assembly as defined in claim 19, said prongs being engageable with an edge of said tensioning bar opposite said longitudinal edge thereof.

21. A sign assembly as defined in claim 18, said one of said arms including:

first and second flexible arms portions, each said arm portion having a fixed end extending from one of said edges of said base portion and a free end;

a transverse portion extending between and connecting said free ends of said arm portions, said shoulder engaging means including a shoulder extending outwardly of said transverse portion; and a flexible tongue portion having a fixed end extending from said one of said edges of said base portion between said fixed ends of said arm portions and a free end, said tensioning bar engaging means including at least one prong extending inwardly from said free end of said tongue into the space between said arms and rearwardly toward said base portion.

22. A tensioning clip as defined in claim 21, said tensioning bar engaging means further including at least one prong extending inwardly of the other of said arms and rearwardly toward said base portion.

23. A sign assembly as defined in claim 14, each said tensioning bar being substantially rectangular in edge view, said longitudinal edge being tapered to facilitate insertion thereof into its associate channel and having longitudinally triangular ridges in opposed sides thereof for gripping said flexible sign.

24. A sign assembly as defined in claim 14, wherein said channel of each said frame member extends at an acute angle to said outer side thereof and rearwardly away from said front edge, each said frame member further including a substantially planar longitudinal flange defining said outer side of said frame member;

each said clip comprising a unitary, generally U-shaped body having a substantially rigid base portion and a pair of resilient arms extending from opposed edges of said base portion, said arms being spaced apart to receive in edgewise fashion a tensioning bar therebetween, one of said arms including first and second flexible arms portions, each said arm portion having a fixed end extending from one of said edges of said base portion and a free end, a transverse portion extending between and connecting said free ends of said arm portions, said shoulder engaging means including a shoulder extending outwardly of said transverse portion, and a flexible tongue portion having a fixed end extending from said one of said edges of said base portion between said fixed ends of said arm portions and a free end, means on said arms for retaining said tensioning bar, and sign material folded thereover, operatively positioned between said arms such that a longitudinal edge of said tensioning bar engages said base portion, said tensioning bar engaging means including at least one prong extending inwardly from said free end of said tongue and from the other of said arms into the space between said arms and rearwardly toward said base portion, said prongs being engageable with an edge of said tensioning bar opposite said longitudinal edge thereof, means on one of said arms for engaging a mating shoulder within said channel for retaining said clip and a tensioning bar secured thereto within said channel; and each said tensioning bar being substantially rectangular in edge view, said longitudinal edge being tapered to facilitate insertion thereof into its associated channel and having longitudinally extending triangular ridges in opposed sides thereof for gripping said flexible sign.

* * * * *